US007246501B2

(12) United States Patent
Sohn

(10) Patent No.: US 7,246,501 B2
(45) Date of Patent: Jul. 24, 2007

(54) SHUT-OFF VALVE, KIT HAVING A SHUT-OFF VALVE, AND AN EXPANSION VALVE

(75) Inventor: Jürgen Sohn, Esslingen (DE)

(73) Assignee: Otto Egelhof GmbH & Co. KG, Fellbach (DE)

( * ) Notice: Subject to any disclaimer, the term of this patent is extended or adjusted under 35 U.S.C. 154(b) by 0 days.

(21) Appl. No.: 11/014,599

(22) Filed: Dec. 16, 2004

(65) Prior Publication Data

US 2005/0126218 A1 Jun. 16, 2005

(30) Foreign Application Priority Data

Dec. 16, 2003 (DE) ..... 103 59 151
Aug. 11, 2004 (DE) ..... 10 2004 039 131
Oct. 12, 2004 (DE) ..... 10 2004 049 790

(51) Int. Cl.
*F25B 41/04* (2006.01)

(52) U.S. Cl. ..... 62/225; 236/92 B

(58) Field of Classification Search ..... 62/225; 236/92 B; 251/129.01–22
See application file for complete search history.

(56) References Cited

U.S. PATENT DOCUMENTS 4,542,852 A 9/1985 Orth et al.
5,588,590 A * 12/1996 Sakakibara et al. ..... 236/92 B
5,979,780 A * 11/1999 Malone et al. ..... 236/92 B
6,053,417 A * 4/2000 Hotta et al. ..... 236/92 B
6,325,296 B1 * 12/2001 Dayton ..... 236/92 B
6,530,528 B2 * 3/2003 Breyer et al. ..... 236/92 B
7,036,744 B2 * 5/2006 Hirota ..... 236/92 B

FOREIGN PATENT DOCUMENTS

DE 10218817 A1 11/2003
DE 10237532 A1 2/2004
EP 0874202 A1 10/1998
EP 0907057 A1 4/1999
JP 8210733 8/1996
WO WO 01/27543 A1 4/2001
WO WO 03/091816 A2 11/2003

* cited by examiner

*Primary Examiner*—William E Tapolcai
(74) *Attorney, Agent, or Firm*—Kriegsman & Kriegsman

(57) ABSTRACT

The invention relates to a shut-off valve for an expansion valve (11) in refrigerating systems, in particular vehicle air conditioning systems, having a regulating screw (31), having a receiving section (32), which is arranged at one end of the regulating screw (31) and is intended for the fitting of a travel-generating device (33) which actuates a valve (47) arranged in the regulating screw (31) and opens and closes a first passage opening (53) between an inlet (61) and an outlet (63) of the regulating screw (33), and having a regulating space (76) which is connected downstream of the valve (47) in the direction of flow of a refrigerant and is designed for receiving at least one regulating device (78).

30 Claims, 7 Drawing Sheets

SHUT-OFF VALVE, KIT HAVING A SHUT-OFF VALVE, AND AN EXPANSION VALVE

Figure 1:
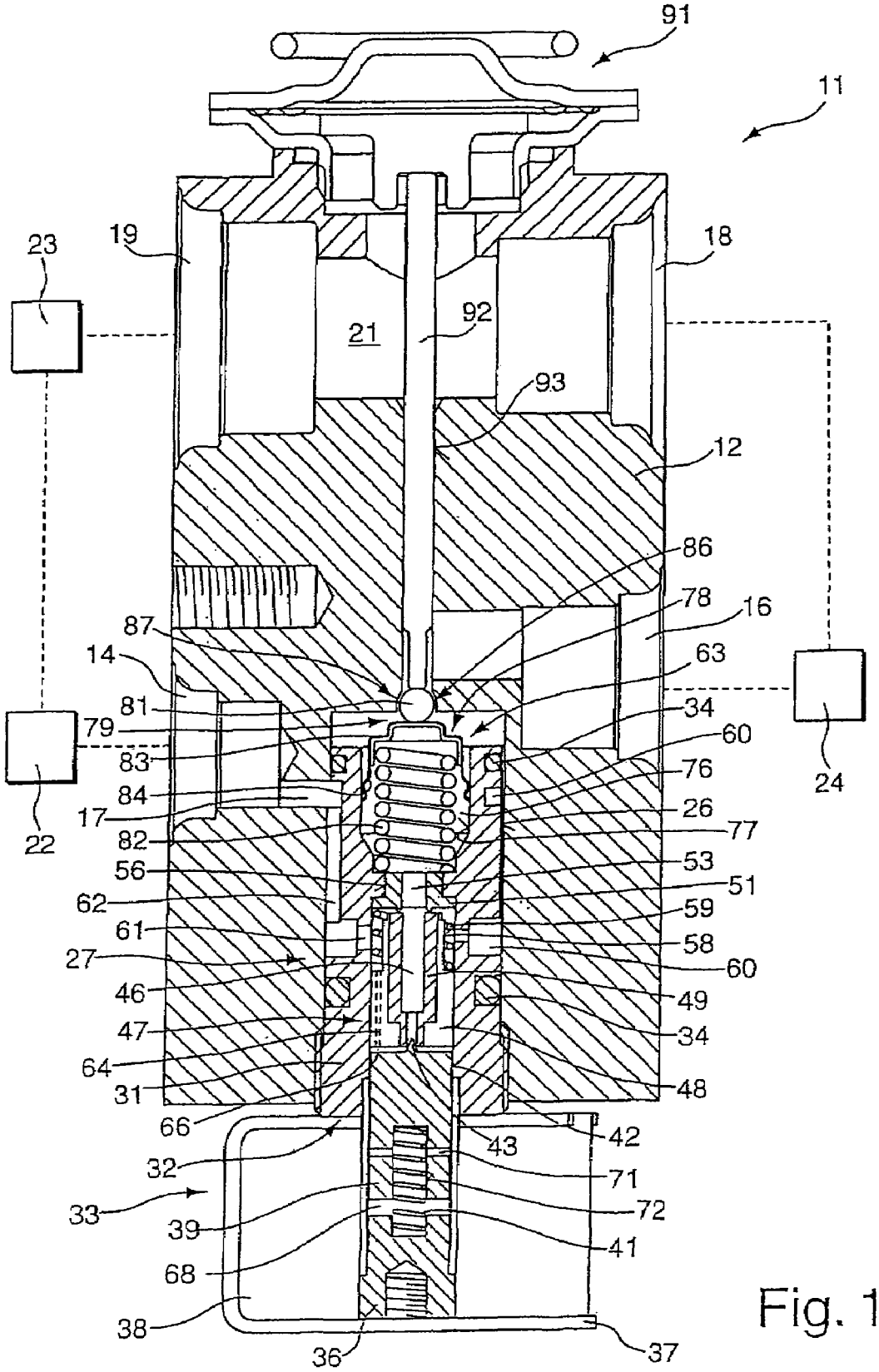

The invention relates to a shut-off valve, a kit having a shut-off valve, and an expansion valve for refrigerating systems, in particular vehicle air conditioning systems, which components are used in a refrigerant circuit.

In vehicles, it is increasingly customary to equip air conditioning systems with at least one additional evaporator in order to be able to undertake separate cooling, for example at the front and rear or on the left and right side of the vehicle interior. To avoid an unnecessary energy consumption, it is desirable to be able to shut off the additional evaporators when they are not required. However, separate shut-off valves arranged in coolant pipes are relatively costly and require additional structural space.

JP 08-210733 A1 has disclosed an expansion valve which, in a housing, accommodates a regulating valve which uses an actuating device, designed as a thermal head, to open and close the expansion valve as a function of a vapour pressure and the temperature in a second refrigerant channel of the housing. A solenoid valve, as travel-generating device, is flange-mounted on an outside of a housing separately from the regulating valve and activates a valve arranged outside the housing and opens and closes a first through-opening. The valve is supplied by a channel which traverses from a first coolant inlet out of the housing and opens into a flange-mounted, separate housing. A further channel is provided from there, the said channel leading from the valve to the housing of the expansion valve and opening into a further channel section which leads to the regulating valve.

This configuration of an expansion valve has the disadvantage of requiring an increased structural space in order to flange-mount a shut-off valve onto an outside of a housing. In addition, a multiplicity of channel sections are required in the housing in order to provide a connection to the shut-off valve, which is arranged on an outside and outside the housing.

The invention is therefore based on the object of providing a shut-off valve for an expansion valve in refrigerating systems, which shut-off valve permits a compact construction of an expansion valve. Furthermore, the invention is based on the object of proposing a kit having a shut-off valve for an expansion valve in refrigerating systems, which shut-off valve permits a flexible design and a compact construction. In addition, the invention is based on the object of providing an expansion valve for refrigerating systems, the expansion valve offering a small structural space and a compact arrangement for a shut-off possibility.

This object for the configuration of a compact shut-off possibility is made possible by means of a shut-off valve which comprises at least one regulating screw which includes at one end at least one receptacle for the fitting of a travel-generating device which actuates a valve assigned to the regulating screw and opens and closes a first through-opening between an inlet and an outlet of the regulating screw, the regulating screw being provided with a regulating space which is connected downstream of the valve in the direction of flow of the refrigerant and is designed for receiving at least one regulating device.

This incentive configuration of the shut-off valve permits an integrated shut-off in an expansion valve. According to the invention, the shut-off valve comprises both a valve for opening and closing the first through-opening and also a regulating valve, as a result of which a compact construction is provided. This shut-off valve is designed in particular, according to the invention, as a unit, thus making it possible to simplify the installation and reduce the structural-member components.

Further advantageous configurations of the shut-off valve are specified in the further claims.

The shut-off valve according to the invention is at least partially, advantageously completely, arranged in a housing of an expansion valve. The valve and the regulating device are positioned here between a first coolant inlet opening and a first coolant outlet opening, thus permitting a space-saving arrangement.

According to one advantageous configuration of the shut-off device, the travel-generating device is integrated on the regulating screw. As a result, the travel-generating device, which is preferably designed as a solenoid valve, is part of the shut-off valve, thus resulting in an even more compact construction of the shut-off valve that in turns permits a reduction of the entire structural space for an expansion valve.

According to one advantageous configuration of the invention, the shut-off valve is positioned in a through-channel between a first coolant inlet opening and a first coolant outlet opening. This makes it possible, in particular, for the inflow path to the valve of the first passage opening and also for the evaporation space connected downstream of the regulating valve to be designed such that they are small and for them to be produced in a simple manner in a housing of the expansion valve.

The regulating space of the shut-off valve for receiving at least one regulating device is advantageously provided at an end of the regulating screw which faces the first coolant exit opening. As a result, an integrated and compact arrangement of the regulating device can be provided.

According to one preferred embodiment of the shut-off valve, the regulating device is arranged interchangeably in the regulating space. This permits a simple adaptation or conversion of the shut-off valve to different use conditions through the use of correspondingly provided regulating devices. At the same time, it is possible for the regulating device to be rapidly retrofitted and converted, with a removal of the shut-off valve sufficing for this.

According to a first advantageous embodiment, the regulating device is designed as a regulating valve which comprises at least one valve element, preferably a valve ball, at least one damping spring and at least one damping sleeve. This regulating valve interacts with a conical seat which is provided by means of a second passage opening formed in the refrigerant channel. The regulating device is activated via a transmission pin which can be activated by the actuating device, which is designed as a thermal head. This regulating device can therefore be activated in a known manner, the regulating space preferably being designed for receiving and/or positioning the regulating device.

The regulating device, which is designed as a regulating valve, advantageously comprises a damping sleeve having fastening elements acting radially on the regulating space. These fastening elements can act both within and also outside the regulating space. As a result, the regulating valve is securely positioned at least during the phase of fitting the shut-off valve into the housing of an expansion valve.

According to a first preferred embodiment of the regulating device, the damping sleeve of the regulating valve advantageously comprises tabs which act on a preferably cylindrical inner wall section of the regulating space and cause the regulating valve to be secured relative to the regulating space.

As an alternative, to secure the regulating valve, provision may be made for a locking section, which is fitted or put in place after the regulating valve is inserted, to be provided at a free end of the regulating space. The said locking section may be, for example, an annular collar with a shoulder which reduces the cross section of the regulating space, thus providing a securing means. Similarly, this may be provided by the releasable or nonreleasable fastening of a locking section to the regulating space. Furthermore, a deformation of the free end of the regulating space may be provided, for example a beading or compression or notching of tabs, in order to secure the regulating valve relative to the regulating space.

According to the first advantageous configuration of the regulating device, the regulating valve is preferably designed as a unit of components connected fixedly to one another. The valve ball, the damping spring and the damping sleeve are, for example, bonded or welded to one another.

According to a further alternative embodiment, the regulating device is designed as at least one orifice plate which is assigned to the regulating space or is arranged in the housing section. The at least one orifice plate advantageously has at least one regulating opening which forms a second through-opening in the refrigerant channel. The orifice plate is arranged adjacent to the regulating space or is inserted into the regulating space. Similarly, the orifice plate may also at least partially engage around and enclose the regulating space, so that the refrigerant expands via the second through-opening and comes directly into connection with the first refrigerant discharge opening. As an alternative, provision may be made for the orifice plate to be arranged in the housing section and to be positioned in the housing separately from the regulating screw.

The at least one regulating opening of the at least one opening is of cylindrical, concave, convex, nozzle-shaped, wedge-shaped, slot-shaped and/or segment-shaped design as seen in cross section. The shapes and/or sizes and/or number of the regulating openings in the orifice plate can be appropriately provided as a function of the use situations and the ratios of sizes of the refrigerant channel provided upstream and downstream of the regulating opening, in order to be able to set and obtain the desired effect.

According to a further advantageous embodiment of the regulating device, which is designed as an orifice plate, at least two regulating devices are placed in an orifice plate, with at least one regulating opening opening and closing as a function of the vapour pressure of the refrigerant that prevails in the regulating space. This regulating opening which is controlled by the vapour pressure can be formed, for example, by means of a spring-mounted valve element, for example by means of a ball or cone.

According to a further advantageous configuration of the regulating device, which is designed as an orifice plate, a cross section of the at least one regulating opening can be activated as a function of the vapour pressure. This enables the regulating opening to be adapted in a variable manner to the use conditions. At the same time, a gentle increase or reduction in the regulating opening can contribute to reducing differences in pressure which occur and therefore to reducing vibrations.

The at least one orifice plate, which is designed as a regulating device, is advantageously designed as an insert or installation part which is fastened releasably to the regulating space by means of a latching, snap, clip or screw connection, for example, or is fastened nonreleasably to the regulating space by means of a press, adhesive or crimping connection or else by a beading. The releasable arrangement has the advantage of permitting a rapid conversion to different use situations by means of orifice plates which differ in design.

According to an advantageous configuration of the invention, the shut-off valve comprises an orifice plate or a regulating device which is arranged as a replaceable unit in the housing section or on the regulating screw. This enables the flexibility for the configuration of a shut-off valve to be increased. A modular design for the orifice plate or the regulating device can be made possible as a function of the particular operating conditions and requirements in respect of the opening time of the shut-off valve. For example, provision is made for the orifice plate or the regulating device to be connected to the regulating screw via a releasable connection, for example a screw, clamping or latching connection or the like, and to a form a unit which is inserted into the housing section for receiving the shut-off valve. This advantageous configuration also permits a retrofitting or conversion of an expansion valve with different opening pressures and opening characteristics.

A valve seat is advantageously formed between the replaceable unit and the regulating screw, the said valve seat being arranged as an insert situated in between or the valve seat being integrally formed on the replaceable unit or the regulating screw. Since the valve seat is subject to increased wear, a rapid exchange of an individual component can be made possible by means of the insertable unit. The valve seat, which is arranged on the orifice plate or the regulating screw, has the advantage of permitting a reduction in the components for the installation of the shut-off valve.

According to a further advantageous configuration of the invention, the valve or a sleeve of the valve has, in the outer edge region, a passageway which connects an inlet to a gap between the valve and the travel-generating device. This passageway serves as a servo activation for opening the valve seat without impact noises.

According to one advantageous embodiment, this passageway may be formed by an axial bore which extends coaxially with a through-bore of the valve. An alternative embodiment to the axial bore may be formed by a longitudinal groove which is open at the edge and which makes it possible for refrigerant to pass from the inlet to the gap between the valve and the movement-generating device. A further alternative configuration of a passage is provided by a gap or an annular gap being provided between the outer circumference of the valve or the sleeve of the valve and a bore section of the regulating screw for receiving the valve. To axially guide the valve in the bore section, as an alternative or in addition longitudinal webs which are distributed over the circumference may be provided, it being possible for the said longitudinal webs also to have interruptions in the longitudinal extent in order to serve for the radial support of the valve in the bore section. Any desired combination of embodiments is possible.

According to a further advantageous configuration of the invention, at least one damping element is provided between a tappet and an armature of the travel-generating device. The damping element comprises at least one compression spring which positions the tappet in a closed position with respect to the valve and damps the opening movement. In addition or as an alternative, an elastomeric damping element is provided and prevents the tappet from moving in the direction of striking against the armature during an opening movement.

According to a further advantageous configuration of the shut-off valve for an expansion valve, provision is made for there to be at least one adapter element which at least partially surrounds the regulating screw and is designed for insertion into a housing section of the expansion valve. As a result, through the configuration of different adapter elements uniformly produced shut-off valves can be used for different housings of the expansion valves.

The object of the invention is furthermore achieved by a kit having a shut-off valve for an expansion valve, the said kit comprising

- a housing which has at least one first coolant inlet opening and a first coolant outlet opening which are connected to each other by a refrigerant channel,
- a shut-off valve having a receiving section for a travel-generating device for actuating a valve which opens and closes a first passage opening and receives a regulating device which contains a second passage opening, it being possible for the shut-off device to be arranged in the refrigerant channel between the first coolant inlet opening and the first coolant outlet opening,
- an actuating device for moving the regulating device relative to the second passage opening, in particular via a transmission pin acting on the regulating device and
- at least one closure element which closes a receiving section and bore section for the actuating device or a housing section for receiving the shut-off valve.

This novel configuration of the kit makes it possible to provide a product family comprising at least three different expansion valves, which is cost-effective to produce because of the uniform configuration of the individual components and, in addition, permits a compact configuration of a structural space. The novel configuration of the kit having a shut-off valve for an expansion valve makes it possible for a product family to be installed in a flexible and cost-effective manner.

For example, the configuration of a "standard expansion valve" is made possible, the said valve comprising a housing having an actuating device which is configured as a thermal head and activates a shut-off valve with a regulating device. This standard valve is formed without the travel-generating device. A closure element is provided in the housing section.

A second embodiment comprises both a housing having an actuating device and a shut-off valve having a travel-generating device. All of the components of the kit with the exception of the closure device are used for this.

A further alternative embodiment corresponds to the abovementioned embodiment without an actuating device being used. Instead of the actuating device inserted into the housing, a closure element is used for closing a through-bore, leading to the regulating device, in the housing.

According to one advantageous configuration of the kit according to the invention, the possibilities for varying the product family of an expansion valve are increased by this interchangeable arrangement of the regulating device.

According to a first advantageous embodiment, the regulating device is designed as a regulating valve having at least one valve ball, at least one damping spring and at least one damping sleeve. According to a further alternative embodiment of the regulating device, an orifice plate having at least one regulating opening is added to the kit. This enables the provision of expansion valves which can be shut off, have an actuable regulating valve or comprise a fixed orifice plate, so that an expansion valve which can be shut off comprises an "orifice valve which can be shut off".

The kit according to the invention can advantageously comprise an adapter element which receives the shut-off valve and can be inserted in a housing section which extends at least partially into the coolant channel between a first coolant entry opening and a first coolant exit opening. This enables the number of expansion valves in a product family to be increased.

The object of the invention is furthermore achieved by an expansion valve for refrigerating systems, in particular for vehicle air conditioning systems, which valve comprises a housing having at least one first refrigerant inlet opening and at least one first refrigerant outlet opening, which are connected to each other by at least one refrigerant channel, and a housing section for a shut-off valve which has a valve for controlling a first passage opening and a regulating device, the housing section extending at least partially into the refrigerant channel.

This novel configuration permits an integrated arrangement of the shut-off valve in the expansion valve, the shut-off valve comprising a valve controlling a first passage opening, and a further regulating device.

Provision is advantageously made for the regulating device to be designed as an orifice plate. As a result, an orifice valve which can be shut off is formed.

According to a further alternative configuration of the expansion valve for refrigerating systems, the housing comprises a receiving section for the fitting of an actuating device for moving the regulating device, which is designed as a regulating valve. In contrast to the previously mentioned expansion valve, this expansion valve in addition merely has a receiving section for the actuating device and a through-hole for a transmission pin, with the outer dimensions corresponding to the previously mentioned expansion valve. In particular, the integrated shut-off is maintained at least partially, preferably completely, in an expansion valve by means of the likewise novel configuration of the shut-off valve.

Further advantageous configurations and refinements of the expansion valve are specified in the further claims.

Figure 2:
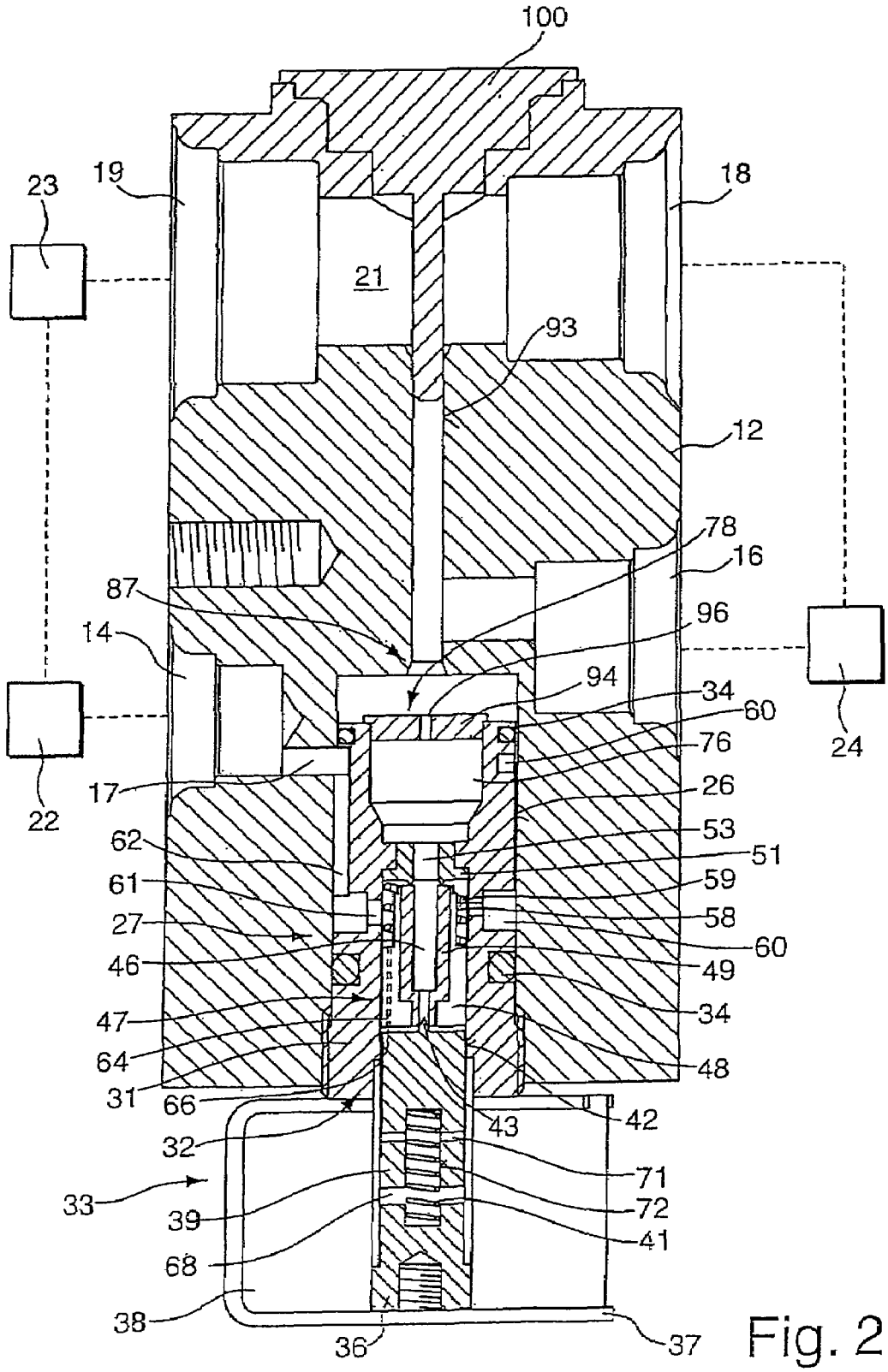
Figure 3A:
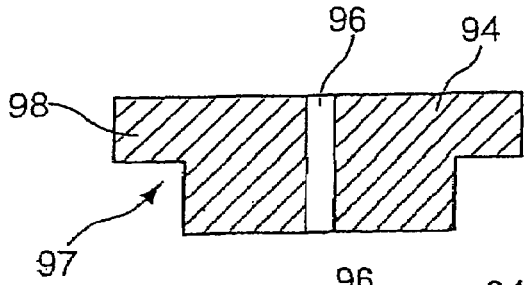
Figure 3B:
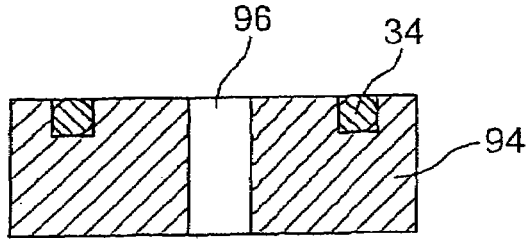
Figure 3C:
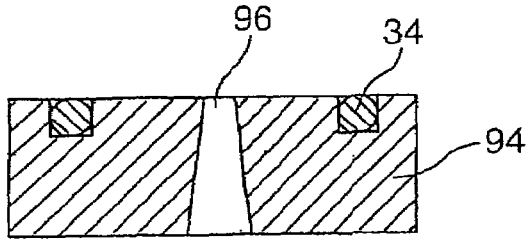
Figure 3D:
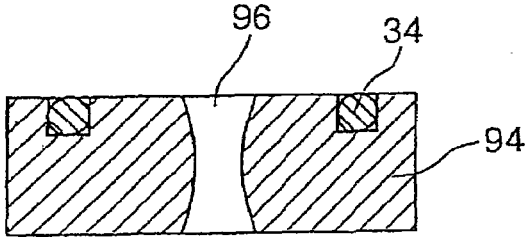
Figure 3E:
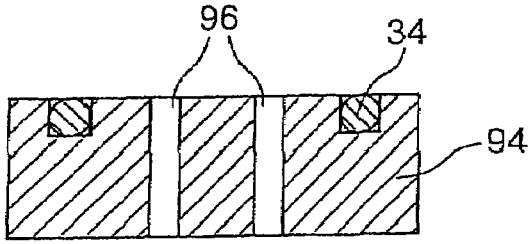
Figure 3F:
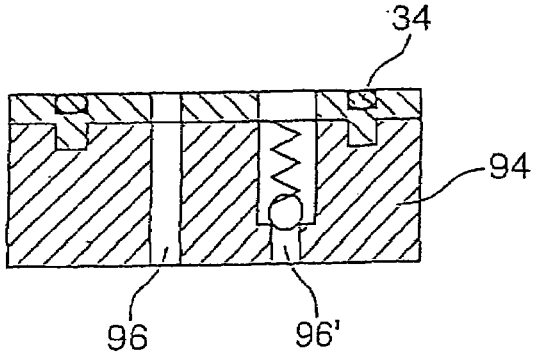
Figure 4:
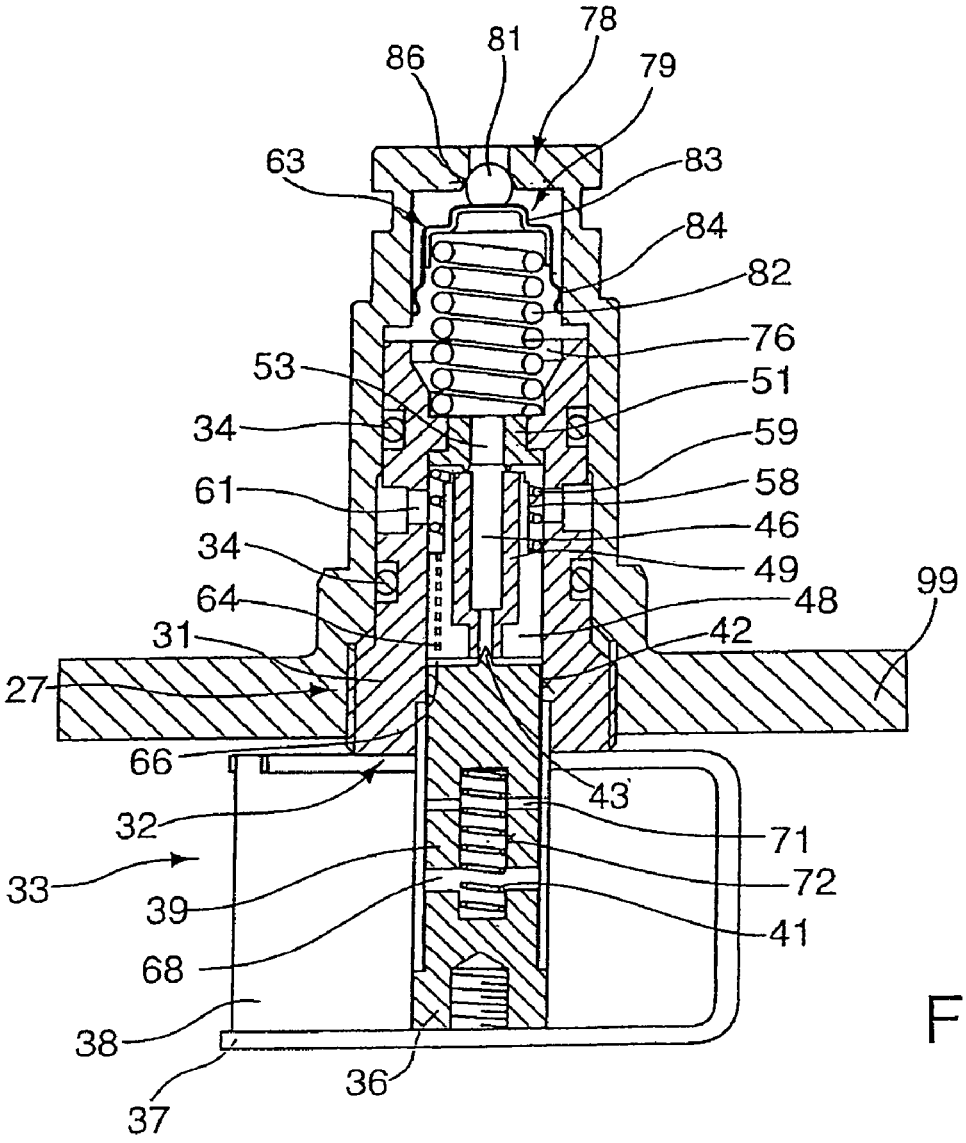
Figure 5A:
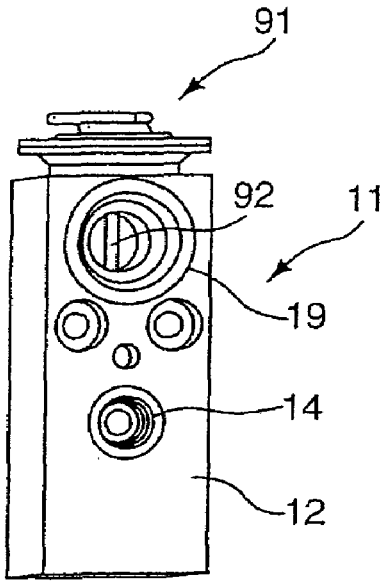
Figure 5B:
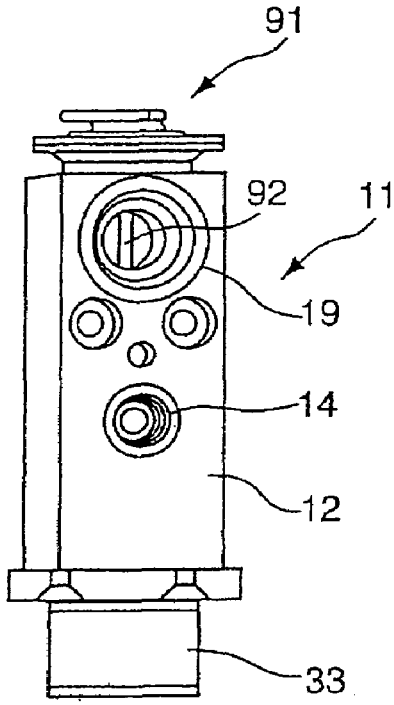
Figure 5C:
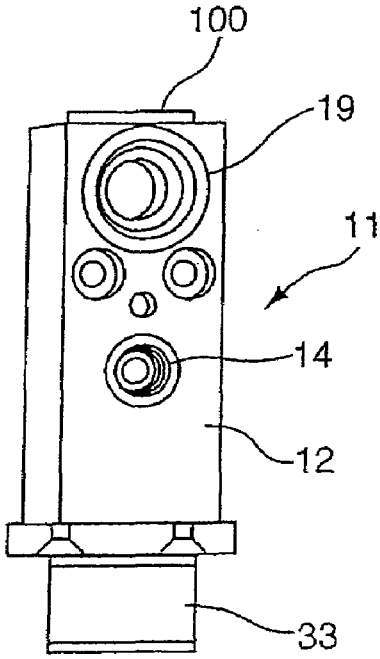
Figure 6:
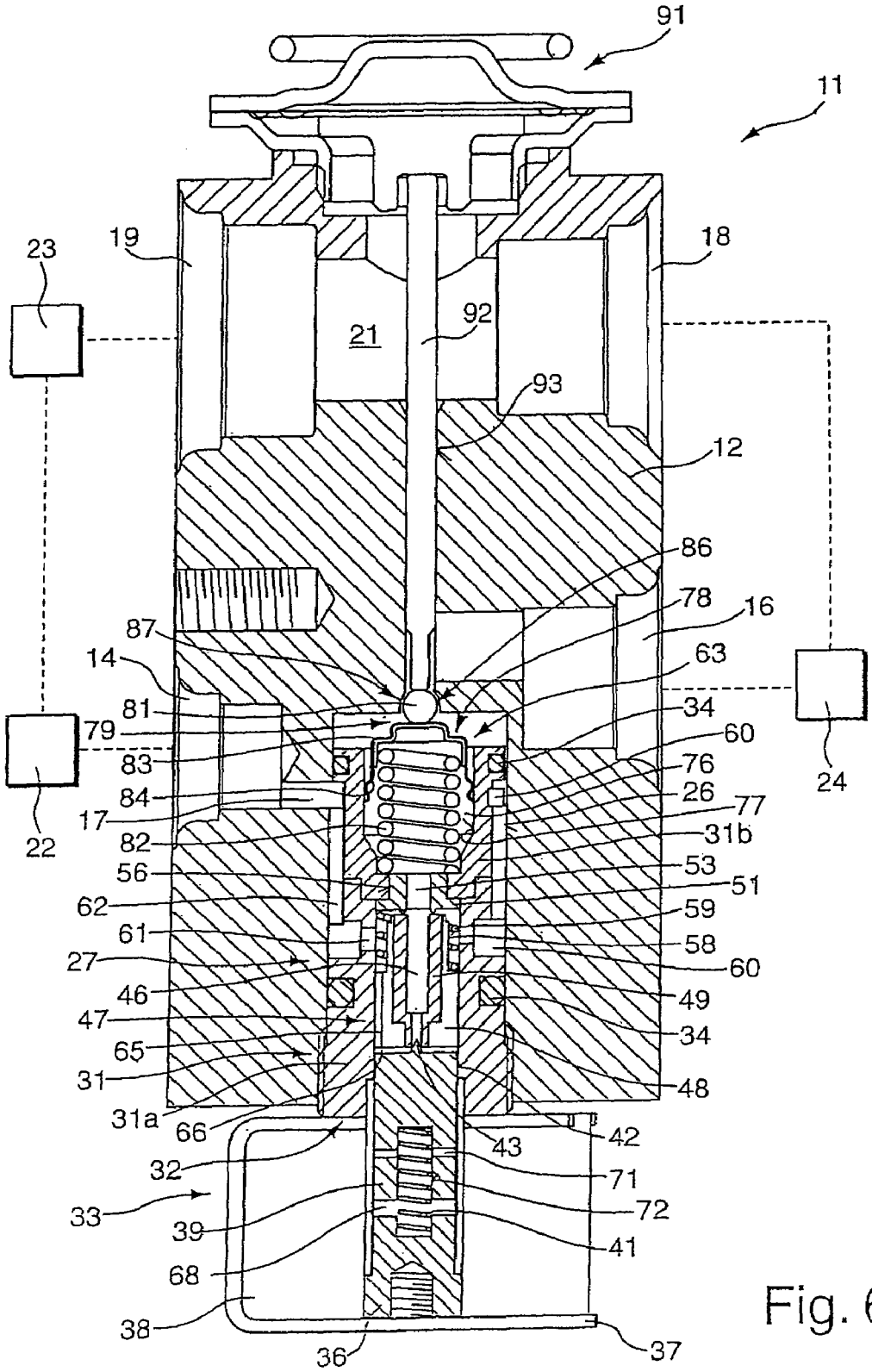
Figure 7:
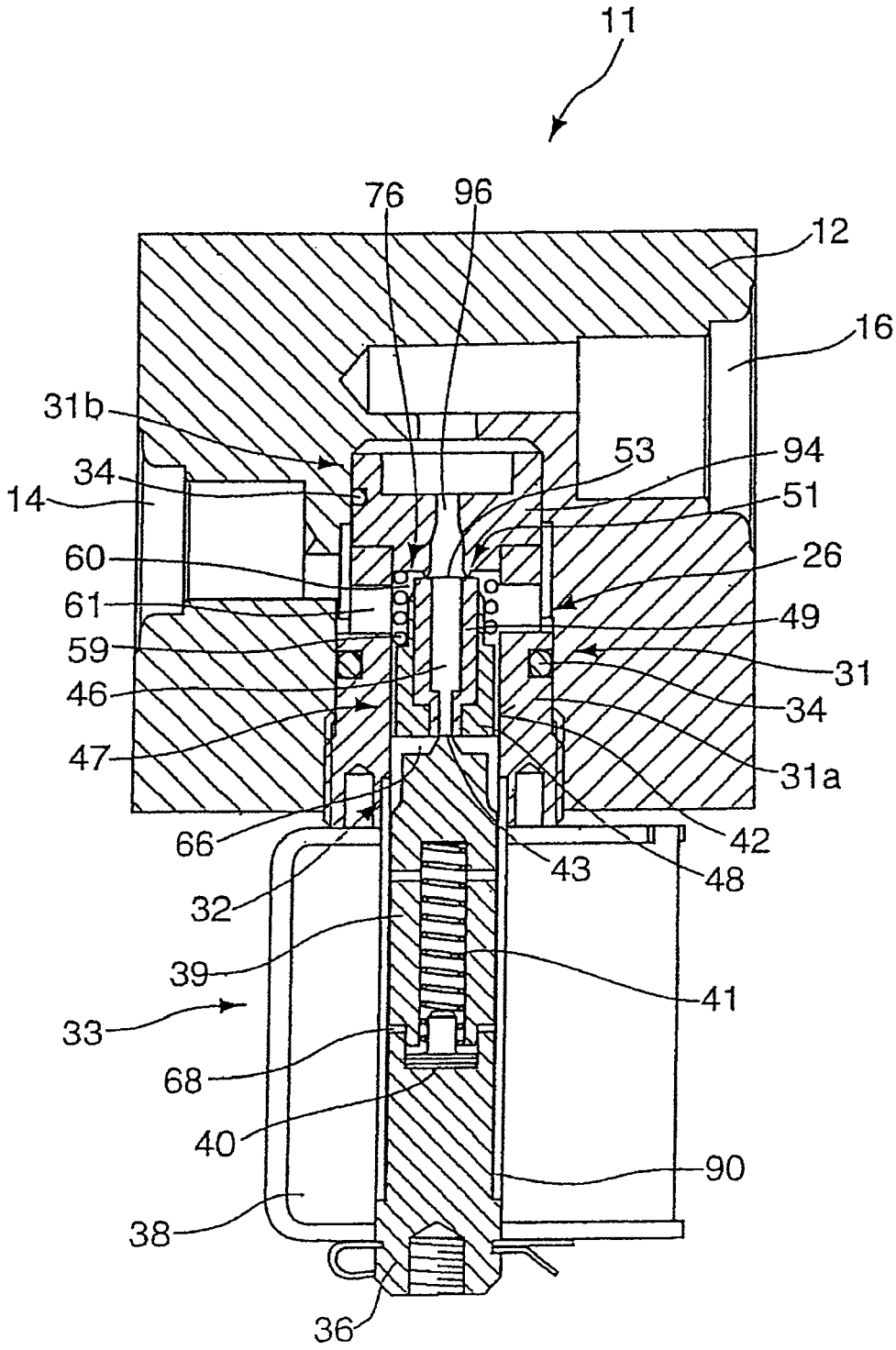

The invention and further advantageous embodiments and refinements of the same are described and explained in greater detail below with reference to the examples illustrated in the drawings. The features which can be gathered from the description and the drawings can be used, according to the invention, individually on their own or a number of them can be used in any desired combination. In the drawings:

FIG. 1 shows a schematic cross section through a first embodiment of an expansion valve according to the invention, FIG. 2 shows a schematic cross section through a further alternative embodiment of an expansion valve according to the invention, FIGS. 3*a* to *f* show a schematic cross section of various embodiments of a regulating device designed according to the invention as an orifice plate, FIG. 4 shows a schematic sectional illustration of a shut-off valve according to the invention having an adapter element, FIGS. 5*a* to *c* show a schematic view of expansion valves which can be produced in accordance with the kit according to the invention, FIG. 6 shows a schematic cross section through a further embodiment of an expansion valve according to the invention and FIG. 7 shows a schematic cross section of a further alternative embodiment of an expansion valve according to the invention.

FIG. 1 illustrates a first embodiment of an expansion valve 11 according to the invention. The expansion valve 11 comprises a housing 12 having a first coolant inlet opening 14, a first coolant outlet opening 16 and a coolant channel 17 connecting the first coolant inlet opening 14 and the first coolant outlet opening 16. The housing 12 is furthermore provided with a second coolant inlet opening 18 and a second coolant outlet opening 19 which are connected to each other by a second coolant channel 21. The exit side of a condenser 22 is connected to the first coolant inlet opening 14 and its entry side is connected to the exit side of a compressor 23. The entry side of the compressor 23 is therefore connected to an exit side of an evaporator 24.

The housing 12 of the expansion valve 11 has a housing section 26 which extends into the housing interior and into a part of the refrigerant channel 17. A shut-off valve 27 can be inserted into the housing section 26. According to the exemplary embodiment, the shut-off valve 27 is advantageously integrated completely in the housing in order to reduce the structural space.

The shut-off valve 27 comprises a regulating screw 31 which acts on the housing section 26 preferably via a thread. The regulating screw 31 is designed as a hollow-cylindrical body and, at one end, has a receiving section 32 for the arrangement of a travel-generating device 33. According to the exemplary embodiment, this travel-generating device 33 is designed as a solenoid valve and comprises an armature 36 which is held by a retaining clip 37 which, in turn, is fastened to the receiving section 32. The armature 36 is partially surrounded by a coil 38 which holds an axially moveable tappet 39 which is positioned in relation to the armature 36 by means of a spring, in particular solenoid spring 41. The tappet 39 is guided in a bore section 42 of the regulating screw 31 and, at an end lying opposite the armature 36, has a valve body 43 which opens and closes a through-bore 46 of the valve 47. The valve 47 comprises a sleeve 48 in which a sealing element 49 is arranged. This sealing element 49 interacts in a sealing manner with the valve body 43. A valve seat 51, on which the sealing element 49 likewise acts in a sealing manner, is provided at an end of the valve 47 that lies opposite the valve body 43. This valve seat 51 forms a first passage opening 53 in the refrigerant channel 17. This valve seat 51 is pressed, screwed or the like into a second bore section 56 of the regulating screw 31 or is formed integrally with the regulating screw 31.

The valve 47 has, on an outside, a receiving section 58 for a closing spring 59 which is supported at one end on the valve seat 51 and at the other end on a shoulder of the receiving section 58. The receiving section 58 extends in the longitudinal direction at least along an inlet 61 in the regulating screw 31, which inlet forms part of the coolant channel 17 and is connected thereto.

The regulating screw 31 has, for example, an upper and a lower annular groove 60 which are connected to a longitudinal channel 62, so that the refrigerant passes from the coolant inlet opening 14 to the inlet 61. Alternative supply possibilities are likewise possible.

The regulating screw 31 is arranged in the housing section 26 of the housing 12 in a media- and/or pressure-tight manner by means of sealing elements 34.

The sleeve 48 of the valve 47 has, in the outer edge region, an axial bore 64 which forms a connection between the inlet 61 and a gap 66, the gap 66 being formed between the tappet 39 and the sleeve 48. A servo activation is made possible by means of this axial bore 64. The axial bore 64 furthermore makes it possible for refrigerant to pass along longitudinal grooves (not illustrated specifically) on the outer circumference of the tappet 49 into an intermediate space 68 which is formed between the armature 36 and the tappet 39.

Furthermore, the tappet 39 can be provided with at least one traverse bore 71 which forms a connection between a longitudinal groove of the tappet 39 and a receiving space 72 for the spring 41. As a result, a detachment of the tappet 39 from the armature 36 after the through-bore 46 is opened is ensured by the magnetic force of the travel-generating device 33.

As an alternative to the traverse bore 71 in the tappet 39, it is possible for at least one depression to be provided on an end side of the tappet 39 that faces the outer 36, the depression extending as far as the outer edge region of the end side. This provides a connection to the gap between the tappet 39 and its guide in the travel-generating device 33, in which connection refrigerant is located. This depression permits a simple detachment of the tappet 39 from the armature 36 after an opening movement without adhesion forces keeping the tappet 39 back on the armature 36. The depression may comprise, for example, geometries in the shape of a V, U, rectangle, semicircle or further geometries. A simple production of this depression is provided by means of a rectilinear profile which extends along an axis over the entire end side. It is also possible, for example, for a plurality of depressions running rectilinearly to also be arranged in a star-shaped manner with respect to one another. Similarly, these depressions may be arranged in the shape of a curved segment or the like. Depressions of this type may be produced by a milling or eroding machining process or by pressing them in.

The inlet 61 in the regulating screw 31 can advantageously be at least partially designed as an annular groove, so that the receiving section 58 is completely surrounded by refrigerants flowing around it.

The sealing element 49 has a through-bore 46 which extends from the valve body 43 of the tappet 39 as far as the valve seat 51. The sealing element 49 is preferably of stepped design, so that a secured arrangement with respect to the valve body 43 is formed. At the opposite end, the sealing element 49 is secured by means of a beading of the sleeve 48, so that long-lasting operation is ensured.

The shut-off valve 27 has a regulating space 76 which is connected downstream of the valve seat 51 in the direction of flow of the refrigerant. This regulating space 76 is provided for receiving a regulating device 78. The regulating device according to the first exemplary embodiment comprises a regulating valve 79 which comprises a ball valve 81, a damping spring 82 and a damping sleeve 83. The ball valve 81 is connected to a preferably conical valve seat 86 which forms a second passage opening 87 in the coolant channel 17.

The regulating valve 79 is inserted into the regulating space 76. Tabs 84 arranged on the damping sleeve 83 act on an inner wall 77 of the regulating space 76, with the result that the regulating valve 79 is positioned and fixed relative to the regulating space 76 of the shut-off valve 27.

In order to actuate the regulating valve 79, an actuating device 91, which is designed as a thermal head and uses a transmission pin 92 to transfer the regulating valve 79 into an open and closed position, is provided.

According to the preferred embodiment illustrated in FIG. 1, the shut-off valve 27 according to the invention has an arrangement in which the valve 47, the regulating valve 79 and the transmission pin 92 and also the travel-generating device 33 are arranged in a common longitudinal axis. As an alternative, provision may also be made for the valve 47 and the travel-generating device 33, for example, to be arranged outside the longitudinal axis and to be arranged on a right or left side wall of the housing 12 and to be likewise at least partially integrated in the housing 12. According to this alternative exemplary embodiment, the refrigerant channel 17 has a deflection with respect to the regulating valve 79 downstream of the valve seat 51.

The functioning of the expansion valve 11 illustrated is as follows:

Starting from the shut-off position of the valve 47 that is illustrated in FIG. 1, in order to conduct the refrigerant further from the liquefier 22 to the evaporator 24, the travel-generating device 33 is activated, as a result of which the tappet 39 is moved towards the armature 36. This enables the valve body 43 to open the through-bore 46, so that refrigerant passes via the axial bore 64 through the through-bore 46 into the interior of the sealing element 46. As a result, a gentle build up of pressure takes place in the sealing element 49. At the same time, the closing spring 59 ensures that the sealing element 49 lifts off from the valve seat 51, thus enabling the first passage opening 53 to be opened up. Owing to the refrigerant which is situated in the intermediate space 68 and to the at least one traverse bore 71 (optionally provided), the tappet 39 is moved in a damped manner into an open position. In an end position, the valve 47 once again bears against the valve body 43 of the tappet 39, as a result of which the refrigerant passes via the inlet 61 directly into the first passage opening 53 to the outlet 63 which, in the first exemplary embodiment, is formed by the openings between the tabs 84. The regulating device 78 is adjusted via the actuating device 91, which is designed as a thermal head, as a function of the vapour pressure and the temperature in the second coolant channel 21.

After the travel-generating device 33 is shut off, the solenoid spring 41 causes the tappet 39 to move the sleeve 48 onto the valve seat 51 counter to the spring force of the closing spring 59, so that the first passage opening 53 is closed. At the same time, a flow and pressure compensation can be provided in the regulating screw 31 by the axial bore 64 and the longitudinal grooves of the tappet 39 in order to enable a gentle closing of the first passage opening 53.

FIG. 2 illustrates an alternative embodiment of an expansion valve 11 according to the invention which receives a shut-off valve 27 according to the invention. In contrast to FIG. 1, it is possible for this expansion valve 11 not to have a through-bore 93 for receiving a transmission pin 92.

If a through-bore 93 is provided, a closure element 100 is inserted into a receiving section for the actuating device 91, the said closure element at the same time closing the through-bore 93.

This alternative design of the shut-off device 27 has a regulating device 78 which is designed as an orifice plate 94, which includes at least one through-bore 96. According to the exemplary embodiment, this orifice plate 94 closes off the regulating space 76. The orifice plate 94 is fastened with respect to the regulating space 76 by a releasable or nonreleasable connection. The orifice plate 94 can alternatively or at least partially be inserted in the regulating space 76 or can at least partially engage in the latter. Similarly, the orifice plate 94 can act on the outer circumference for its fastening. This alternative embodiment of the regulating device 78 provides an arrangement in which a shut-off valve 27 is provided with a controllable orifice plate 94.

According to an alternative embodiment (not illustrated specifically) of the regulating device 78, provision may be made for the orifice plate 94 to independently change the opening cross section of the at least one through-bore 96 as a function of the vapour pressure and the temperature.

The functioning of the novel shut-off valve 27 according to FIG. 2 is analogous to the shut-off valve 27 according to FIG. 1 with the exception of the regulating valve 79 which can be activated via the actuating device 91.

FIGS. 3*a* to *f* illustrate various embodiments for an orifice plate 94. In FIG. 3*a*, the orifice plate is designed as a press-in part, with a shoulder 97 bearing and at least partially engaging on the outer end of the regulating space 76. As an alternative, provision may be made for a screw thread to be provided on the cylindrical inner circumferential wall of the orifice plate 94. Similarly, a section for the beading may be provided. As an alternative, it is likewise possible for the orifice plate 94 to be completely inserted into the regulating space 76 and for an outer section of the regulating space 76 to be beaded in order to fix the orifice plate 94 or for a securing element to be inserted into the regulating space 76.

FIGS. 3*b* to *f* illustrate various cross sections for possible through-bores 96. FIG. 3*b* shows a cylindrical through-bore. As an alternative, provision may also be made for a plurality of through-bores 96 also to be able to be arranged in a groupwise manner with respect to one another.

In FIG. 3*c*, the through-bore 96 is designed such that it tapers in a wedge-shaped or nozzle-shaped manner. In FIG. 3*d*, the through-bore 96 has a cross-sectional profile which tapers in the central region.

In FIG. 3*e*, two through-bores 96 are provided, for example, which, in a plan view (not illustrated), form an annular cross section or the like.

FIG. 3*f* illustrates an orifice plate 94 having a through-bore 96 which cannot be regulated and a through-bore 96' which can be regulated. This can be made possible, for example, by means of a spring-mounted valve body and a valve seat.

FIG. 4 illustrates a further alternative embodiment of a shut-off valve 27 according to the invention. The shut-off valve 27 corresponds in functioning to the shut-off valve 27 described in FIG. 1. In a departure from the shut-off valve 27 illustrated in FIG. 1, the shut-off valve 27 according to FIG. 4 has an adapter element 99 which completely surrounds the regulating screw 31. This adapter element 99 can be at least partially, preferably completely, inserted into a housing section 26 of the housing 12. In this embodiment, the regulating space 76 is only of shortened design and serves to receive and/or position the damping spring 82. The damping sleeve 83 acts with the tabs 84 on an inner wall of the adapter element 99. The possibility of adapting the outer circumference of an adapter element 99 to the shape and size of the housing section 26 makes it possible for the shut-off valves 27 according to the invention to be retrofitted by means of adapter elements 99 and to be inserted into different expansion valves 11.

FIGS. 5*a* to *c* illustrate three different expansion valves 11 which can be realized on the basis of the kit provided according to the invention.

In FIG. 5*a*, the expansion valve 11 has a housing 12 and an actuating device 91 by means of which a regulating device 78, which is arranged in a regulating screw 31, can be activated via the transmission pin 92. The regulating device 78 is designed as regulating valve 79.

In FIG. 5*b*, an expansion valve 11 which can be shut off is provided with a regulating valve 79 as regulating device 78. It is obvious from this illustration that the shut-off valve 27, with comprises the valve 47 and the regulating device 78, is arranged and integrated completely in the housing 12. The housing 12 receives the actuating device 91 on an upper side.

FIG. 5*c* illustrates a further alternative configuration of an expansion valve 11 which can be shut off and having a regulating device 78 which is designed as an orifice plate 94.

A receiving section of the housing 12 for the actuating device 91 is closed by a closure element 100. In this case, the through-bore 93, which forms a bypass line, is closed in order to prevent a short circuit between the first and second coolant channels 17, 21.

The kit according to the invention therefore permits a cost-reduced production of the components and also a compact construction for expansion valves 11 which have different components and fulfil different requirements.

FIG. 6 illustrates an alternative embodiment of an expansion valve 11 from FIG. 1. Reference is made thereto in respect of the corresponding features.

FIG. 6 shows, by way of example, an alternative configuration of a valve 47, in which, instead of an axial bore 64 according to FIG. 1, there is formed at least one longitudinal groove 65 which likewise enables refrigerant to be supplied from the inlet 61 to the gap 66 for the purpose of the servo activation. As an alternative to the longitudinal groove 65 or axial bore 64, the configuration of a defined gap between the bore section 42 of the regulating screw 31 and the outer circumference of the valve 47 or of the sleeve 48 of the valve 47 is provided. The size of the gap determines the flow rate. It goes without saying that a combination of the individual described embodiments is also possible. The configuration of the servo activation described is not restricted to the expansion valve according to FIG. 1 and FIG. 6.

Furthermore, in FIG. 6, in order to obtain a quiet and impact-free operation provision is made for a damping element 40 to be provided on its own or in addition to the spring 41. This prevents the tappet 39 from striking against the armature when the travel-generating device 33 is activated.

According to a further advantageous configuration, a two-part regulating screw 31 is provided. The regulating spring 31 may alternatively also be of multipart design. The exemplary embodiment provides a regulating-screw section 31*a*, which receives the valve 47, and includes a bore section 42 for receiving the travel-generating device 33. A regulating device 78 is received in a regulating-screw section 31*b* which is fastened releasably to the regulating-screw section 31*a*. The regulating-screw section 31*b* may alternatively also be provided for receiving an orifice plate 94. As a result, a flexible configuration and equipping of the regulating-screw section 31*a* for a shut-off valve is provided. The regulating-screw section 31*b* may also nonreleasably contain an orifice plate 94 or regulating device 78. The valve seat 51, for example as an insert, is retained with respect to the regulating-screw section 31*b* via a shoulder. As an alternative, the valve seat 51 may also be pressed into the regulating-screw section 31*b* or integrally formed directly on it.

The alternative embodiments described in FIG. 6 may also be used in the further exemplary embodiments either individually or in combination.

FIG. 7 illustrates a two-port expansion valve 11 as an alternative. The housing 12 comprises a first coolant inlet opening 14 and a first coolant outlet opening 16, the throughflow of the refrigerant being controlled by a valve 47. The shut-off valve 27 comprises a two-part regulating screw 31, the regulating-screw section 31*b* being designed as an orifice plate 94 having a regulating bore 96 and being connected to the regulating-screw section 31*a* via a screw connection, for example. The orifice plate 94 furthermore contains the valve seat 51. The valve 47 is received in the bore section 42 and has a passage for the servo activation.

Owing to the two-part construction, the shut-off valve 27 can be fitted with the orifice plate 94, which is intended for the envisaged case of use and is fixed relative to the regulating-screw section 31*a* as regulating-screw section 31*b*. Following this, the closing spring 59 and the valve 47 are then inserted into the bore section 42 of the regulating screw 31 and into the regulating-screw section 31*a*, respectively. A sleeve 90 is then advantageously inserted into the bore section 42. This sleeve 90 is also referred to as the armature sleeve. The tappet 39 is introduced into this sleeve 90. After the spring 41 and, if appropriate, the damping element 40 are inserted, the armature 36 is inserted in order then to be fixed with respect to the sleeve 90 together with the magnet coil 38, which is pulled over the sleeve 90.

An analogous assembly also applies to the previously described embodiments which comprise a regulating device 78 instead of an orifice plate 94. Individual deviations in the sequence may expediently be provided. The individual steps for assembling the valve 11 are independent of the multiplicity of components for the shut-off valve 27 and of the fastening of them with respect to one another.

The orifice plates 94 described in FIGS. 2, 3*a* to *f* and 7 may additionally be provided with a filter element. This filter element may be provided in an exchangeable manner in the regulating bore 96 or connected upstream or downstream of the regulating bore 96. Likewise, in the case of the further described embodiments, a filter or filter element may be provided in the first passage opening 53 of the valve seat 51 or connected downstream of this through-bore.

The above-described features of each exemplary embodiment can be combined with one another as desired and are not restricted to the exemplary embodiments described.

What is claimed is:

1. Shut-off valve for an expansion valve in refrigerating systems, having a regulating screw, with a receiving section, which is arranged at one end of the regulating screw for a travel-generating device wherein a valve is arranged in the regulating screw and opens and closes a first passage opening between an inlet which is connected with a coolant channel of a first coolant inlet opening connected with a condensor and an outlet of the regulating screw and said valve is actuated by the travel-generating device, and a regulating space is provided to the regulation screw which is connected downstream of the valve in the direction of flow of a refrigerant and is designed for receiving at least one regulating device.

2. Shut-off valve according to claim 1, characterized in that the regulating screw is at least partially arranged in a housing of an expansion valve.

3. Shut-off valve according to claim 1, characterized in that the travel-generating device is integrated on the regulating screw.

4. Shut-off valve according to claim 1, characterized in that the regulating screw is positioned interchangeably in a housing of the expansion valve between a first coolant inlet and a first coolant outlet.

5. Shut-off valve according to claim 1, characterized in that the regulating space is designed such that it is open towards the first refrigerant outlet in order to receive the regulating device.

6. Shut-off valve according to claim 1, characterized in that the regulating device is arranged interchangeably in the regulating space.

7. Shut-off valve according to claim 1, characterized in that the regulating device is designed as a regulating valve having at least one valve element, at least one damping spring and at least one damping sleeve.

8. Shut-off valve according to claim 7, characterized in that the at least one damping sleeve has fastening elements which act radially on the regulating space and secure the regulating device relative to the regulating space.

9. Shut-off valve according to claim 8, characterized in that the fastening elements are designed as tabs which act under prestress on a cylindrical inner wall of the regulating space.

10. Shut-off valve according to claim 7, characterized in that a locking section which secures the regulating device relative to the regulating space is provided at a free end of the regulating space, which end lies opposite the valve.

11. Shut-off valve according to claim 7, characterized in that a valve ball, the damping spring and the damping sleeve are connected fixedly to one another.

12. Shut-off valve according to claim 1, characterized in that the regulating device is designed as at least one orifice plate which is assigned to the regulating space or is arranged in the housing section.

13. Shut-off valve according to claim 12, characterized in that the orifice plate has at least one regulating opening and is of cylindrical, concave, convex, nozzle-shaped, wedge-shaped, slot-shaped or segment-shaped design as seen in cross section.

14. Shut-off valve according to claim 12, characterized in that the orifice plate has at least two regulating openings, at least one regulating opening opening as a function of the vapour pressure of the refrigerant that prevails in the regulating space and that the orifice plate has a regulating opening which changes in cross section as a function of the vapour pressure.

15. Shut-off valve according to claim 12, characterized in that the orifice plate is fastened relative to the regulating space as an insert by means of a latching, snap, clip or screw connection or by means of a press or adhesive connection or a beading.

16. Shut-off valve according to claim 1, characterized in that an orifice plate or the regulating device is arranged as a replaceable unit in the housing section or on the regulating screw.

17. Shut-off valve according to claim 16, characterized in that a valve seat is inserted between the replaceable unit and the regulating screws or in that the valve seat is integrally formed on the replaceable unit or the regulating screw.

18. Shut-off valve according to claim 1, characterized in that the valve or a sleeve of the valve has at least one eccentrically arranged axial bore, at least one longitudinal groove which is open at the edge facing the bore section of the regulating screws or, at least between the valve and the bore section of the regulating screw, a gap which connects the inlet to a gap between the valve and the travel-generating device.

19. Shut-off valve according to claim 1, characterized in that the travel-generating device has at least one damping element between an armature and a tappet.

20. Shut-off valve according to claim 1, characterized in that there is at least one adapter element which is provided for receiving the regulating screw and for insertion into a housing section of an expansion valve.

21. Kit having a shut-off valve according to claim 1, for an expansion valve, for vehicle air conditioning systems, comprising a housing which has at least one first refrigerant inlet and at least one first refrigerant outlet which are connected to each other by a refrigerant channel, a shut-off valve having a receiving section for a travel-generating device for actuating a valve which opens and closes a first passage opening and receives a regulating device which contains a second passage opening, it being possible for the shut-off device to be arranged in the refrigerant channel between the first coolant inlet opening and the first coolant outlet opening, an actuating device for moving the regulating device relative to the second passage opening, via a transmission pin acting on the regulating device and at least one closure element which closes at least one receiving section for the actuating device in the housing or a housing section for receiving the shut-off valve.

22. Kit according to claim 21, characterized in that the regulating device comprises a regulating valve having at least one valve element, at least one damping spring and at least one damping sleeve.

23. Kit according to claim 21, characterized in that the regulating device comprises at least one orifice plate having at least one regulating opening.

24. Kit according to claim 21, characterized in that there is at least one adapter element which is provided for receiving the shut-off valve and for positioning it in a housing section of the housing.

25. Expansion valve for refrigerating systems, in particular vehicle air conditioning systems, having a housing which has at least one first refrigerant inlet opening and at least one first refrigerant outlet opening, which are connected to each other by at least one refrigerant channel, having a housing-receiving section for a shut-off device, according to claim 1, having a valve controlling a first passage opening, and a regulating device, the housing section extending at least partially into the refrigerant channel.

26. Expansion valve according to claim 25, characterized in that the regulating device is designed as an orifice plate.

27. Expansion valve according to claim 25, characterized in that the housing has an actuating device for moving the regulating device relative to the second passage opening, via a transmission pin acting on the regulating device, the transmission pin extending into the refrigerant channel.

28. Expansion valve according to claim 25, characterized in that the regulating device is designed as a regulating valve having at least one valve element, at least one damping spring and at least one damping sleeve.

29. Expansion valve according to claim 25, characterized in that at least one adapter element is arranged between the housing section and the shut-off valve and the at least one adapter element includes flow channels which at least guide the refrigerant from the first refrigerant inlet opening to the valve controlling the first passage opening and the at least one adapter element includes a valve seat for the regulating device.

30. Expansion valve according to claim 25, characterized in that the shut-off valve can be inserted into a housing of a two-port or four-port expansion valve.

* * * * *